US006521819B1

(12) United States Patent
Di Iorio

(10) Patent No.: US 6,521,819 B1
(45) Date of Patent: Feb. 18, 2003

(54) STRING INSTRUMENT SUSPENSION SYSTEM

(76) Inventor: Giambattista Di Iorio, 1077 Old Orchard avenue, Montréal, (Québec) (CA), H4A 3A3

( * ) Notice: Subject to any disclaimer, the term of this patent is extended or adjusted under 35 U.S.C. 154(b) by 0 days.

(21) Appl. No.: 09/955,133

(22) Filed: Sep. 19, 2001

(51) Int. Cl.[7] ..... G10D 3/04
(52) U.S. Cl. ..... 84/298; 84/307; 84/453
(58) Field of Search ..... 84/298, 307, 299, 84/453

(56) References Cited

U.S. PATENT DOCUMENTS 3,538,233 A * 11/1970 Compton et al. ..... 84/723
4,248,126 A 2/1981 Lieber
4,430,919 A 2/1984 Matsui

* cited by examiner

*Primary Examiner*—Shih-Yung Hsieh
(74) *Attorney, Agent, or Firm*—Francois Martineau

(57) ABSTRACT

The electric guitar includes a main solid sound box body at one end, a head at the opposite end and an elongated neck integrally interconnecting the head to the solid body. The solid body includes a bridge assembly having a number of bridge saddles. A number of elongated flexible strings are connected at one end to the solid body, straddling the bridge saddles under tension. V-shaped rigid sheet members are taken in sandwich between a corresponding bridge saddle and a registering string section, to move as one with the latter as the string is struck by the user. These V-members work as a suspension system for the strings.

20 Claims, 5 Drawing Sheets

STRING INSTRUMENT SUSPENSION SYSTEM

FIELD OF THE INVENTION

This invention relates to bridge assemblies for stringed instruments, in particular guitars.

BACKGROUND OF THE INVENTION

A guitar is a musical instrument having a large flat-backed sound box, a long fretted neck, and a number of strings (usually six) played by strumming or plucking. In guitars, the bridge and intonation nut or saddle systems do not have inherent string suspension. As it stands, the strings which straddle over the saddles are constantly subjected to wear and tear forces from the tension applied toward the sharp upturned edges of the saddles. This constant frictional shearing force between each other causes the saddles to rapidly damage and the strings to lose their tonality and more easily cut and snap.

More particularly, as the guitar player strikes the strings, the strings move slightly transversely relative to the bridge assembly, and shearing forces are applied at the string by the inversely V-shape saddle, and the string eventually is cut out after a number of hours. These existing saddles cause so much frictional shearing forces to the strings, that they chop them up at the same time the strings wear out, with tearing action at the intonation saddles. Therefore, there is a constant battle between the saddle and the string. The string then needs to be replaced by a fresh one.

A guitar bridge assembly may include for example intonation screws held by a retainer wire. Metal saddles have for example 5 cm string spread and 30 cm saddle radius, with thumbwheel height adjustment and with the mounting posts having 7 cm spacing.

OBJECT OF THE INVENTION

The gist of the present invention is therefore to prolong the useful lifetime of guitar strings and/or of the intonation nuts (also called bridge saddles) thereof, by providing an elbowed sheet piece between an intonation saddle and a registering string portion, that will move "as one" with the string when the string is strummed, plucked, bent or moved.

SUMMARY OF THE INVENTION

The invention therefore relates to an angled rigid member that slips over a corresponding bridge saddle on a guitar bridge. This angled member rests on the inversely V-shape saddle in free floating fashion, and may have a transverse notch receiving the string that rides over the saddle. The angled member slides laterally back and forth on the saddle carrying the string, repeatedly as the string is repeatedly struck and transverse to the string, as the string vibrates, such that the angled member and the string member "move as one" relative to the stationary underlying saddle. In this fashion, the string is shielded from frictional shearing forces borne from the string being tensioned toward the sharp upturned edge of the bridge saddle. This angled sheet member slides lengthwisely on the bridge saddle, during this string motion, thus not affecting the sound intonation brought by the bridge assembly and string combination.

More particularly, the invention relates to an elbowed rigid sheet piece for use over a stationary bridge saddle in free floating fashion between the latter and a movable guitar string, said sheet piece defining a first leg and a second leg integrally joined to one another by an apex area, said sheet piece defining: an arcuate underface, for example being inversely V-shape or inversely U-shape and with or without the side legs thereof being partly spread apart from one another, this arcuate underface for complementary engagement with the bridge saddle, and an outer face, the apex area of said outer face for transverse frictional engagement by the guitar string, wherein said sheet piece is adapted to move as one with the string over the stationary bridge saddle both as this string is struck by a guitar player and as this string is released by the guitar player.

The angular value at said underface of said elbowed sheet piece may be an acute or an obtuse angle, ranging preferably between 45 and 135 degrees; the length of said sheet piece could also range between 3 and 9 mm. The important feature is not the absolute value of the elbowed sheet piece, but the snug fit over the saddle while remaining slidable over the saddle. It was found that best results were achieved where the angular value of the saddle is equal to or greater by up to 45 degrees relative to the angular value of the elbowed sheet piece. Said sheet piece first leg could be shorter than said sheet piece second leg, in particular if the saddle would form a right triangle in cross-section. A notch could be made transversely of a central portion of said apex portion of said sheet piece outer face, said notch for containment engagement by a string.

The material forming: said sheet piece could be selected from aluminum, titanium, hardwood, bone, silver, gold, diamond, graphite, hard plastic, chrome, nickel, brass, and bronze.

Also, a lead layer could be applied on said sheet piece arcuate underface.

DETAILED DESCRIPTION OF THE PREFERRED EMBODIMENT OF THE INVENTION

Figure 1:
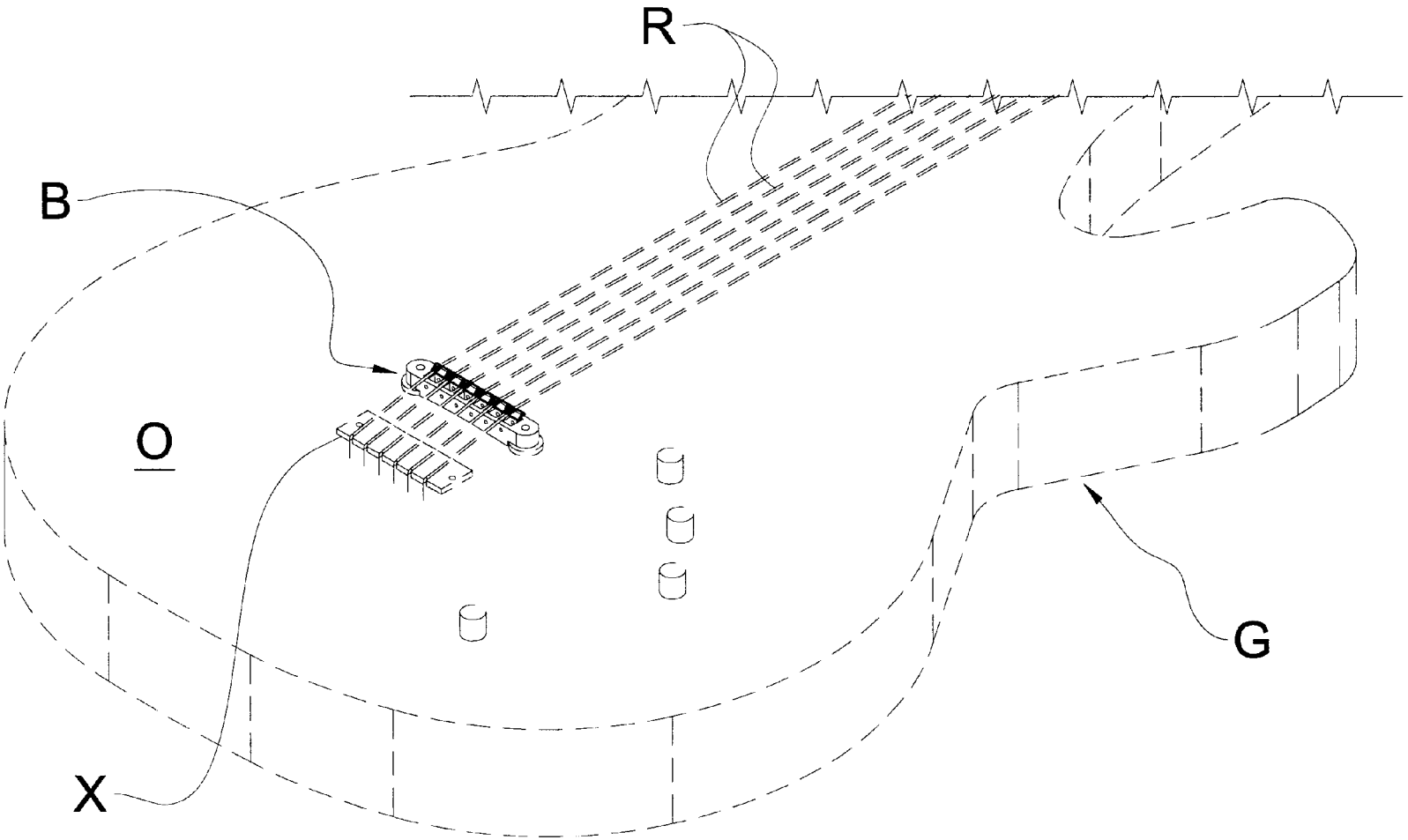
FIG. 1 is a perspective view of a guitar main sound box solid body, shown in phantom lines, including the bridge assembly and corresponding strings sections, and a series of elbowed rigid sheet pieces of the invention in full lines.
Figure 3:
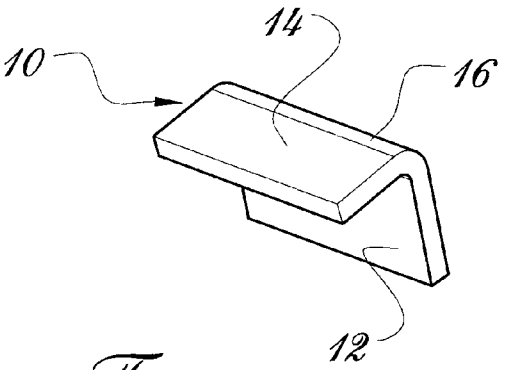
FIGS. 3 and 4 are different perspective views of the invention which are the elbowed sheet pieces or "shock absorbers"
Figure 2:
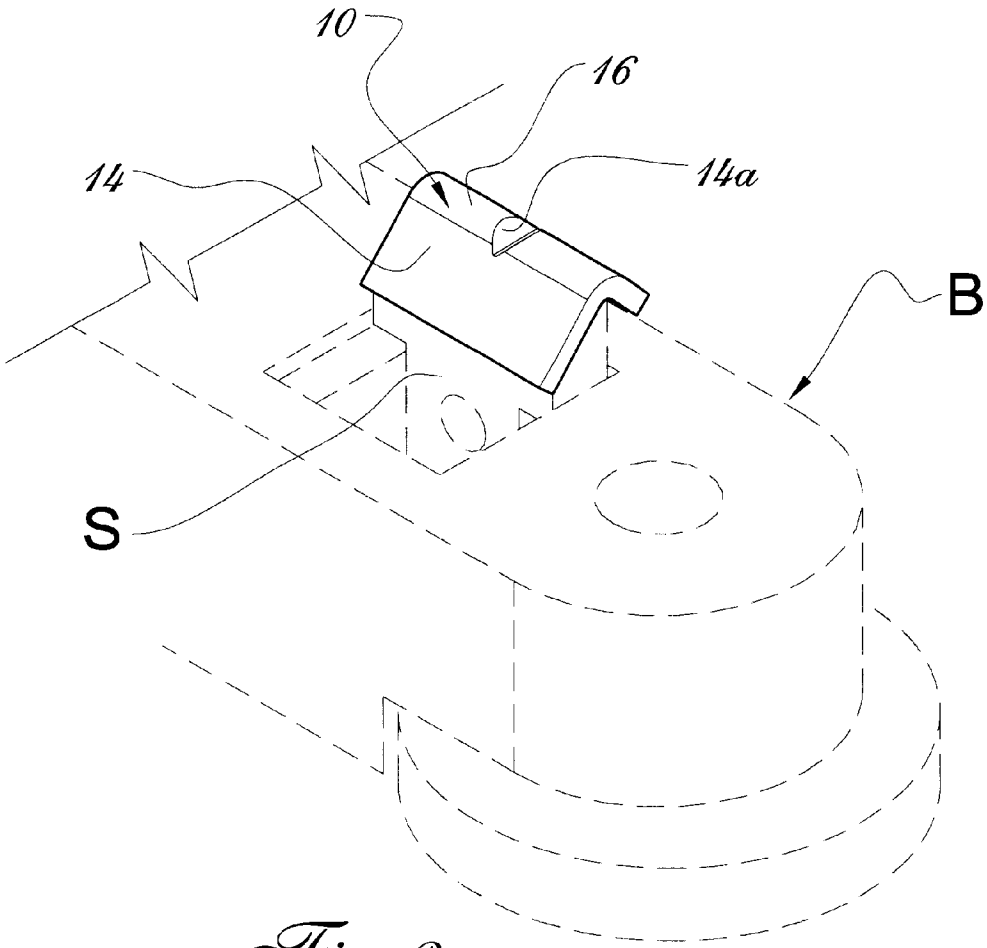
FIG. 2 is an enlarged perspective view of a section of the bridge assembly of FIG. 1, further showing in full lines an elbowed rigid sheet piece according to the invention abutting in operative position against one saddle from the bridge assembly.
Figure 5:
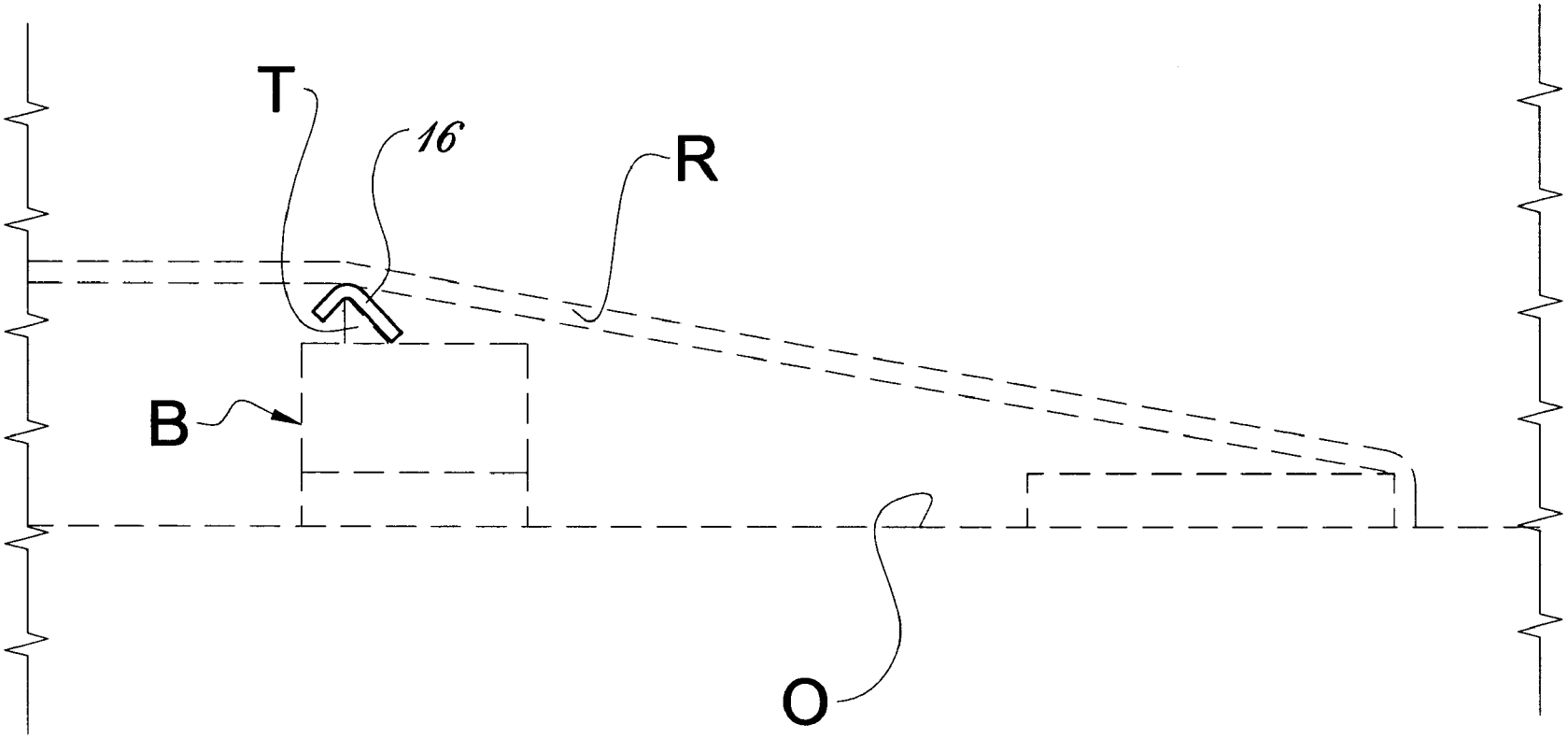
FIG. 5 is a side elevational view of the guitar of FIG. 1, at a larger scale.

As shown in FIGS. 1–2 and 5, the guitar saddle S forming part of the bridge assembly B, integral to and projecting away from the main solid body O of a guitar G, is of generally triangular shape with one transverse tip T. The elbowed sheet piece 10 of the invention is made from a planar rigid material, being of a size substantially that or slightly less than that of the guitar saddle S. For example, the overall length of elbowed sheet piece 10 may range between about 4 to 9 mm in length. The angle of elbowed sheet piece 10 will be for example an acute angle of a value sufficient to accommodate the saddle, for example about 30 degrees, about 45 degrees, about 90 degrees or up to about 135 degrees, so that its underface 12 snugly fits the complementary shaped right triangular shape while remaining slidable about the transverse tip T of the saddle S, provided the elbowed sheet piece sits well and stably over the saddle S so as to be able to remain taken in sandwich between the registering string section R and the saddle S. Strings R are anchored at one end to the tail piece of the sound box frame O at anchor point X, and at the other end to the conventional adjustable tuning pegs (not shown) of the guitar, so that the strings R remain in tension when straddling over the saddles S. Sound box frame O, also called main body, could be for example solid, semisolid,semihollow, or hollow.

The sheet piece 10 may include at the web or apex area 14 of its outer face 16 a transverse central notch 14*a*, for transversely receiving and providing containment for the string R, so as to enhance the cooperation of the string R and sheet piece 10 moving "as one"; but this notch 14*a* is only optional. Notch 14*a* may be made in the original manufacturing process of the sheet piece, or alternately could be allowed to progressively form itself from prolonged use of the sheet piece 10 with a string, in particular if the sheet piece 10 is made from a semi-soft yet rigid material.

Figure 6:
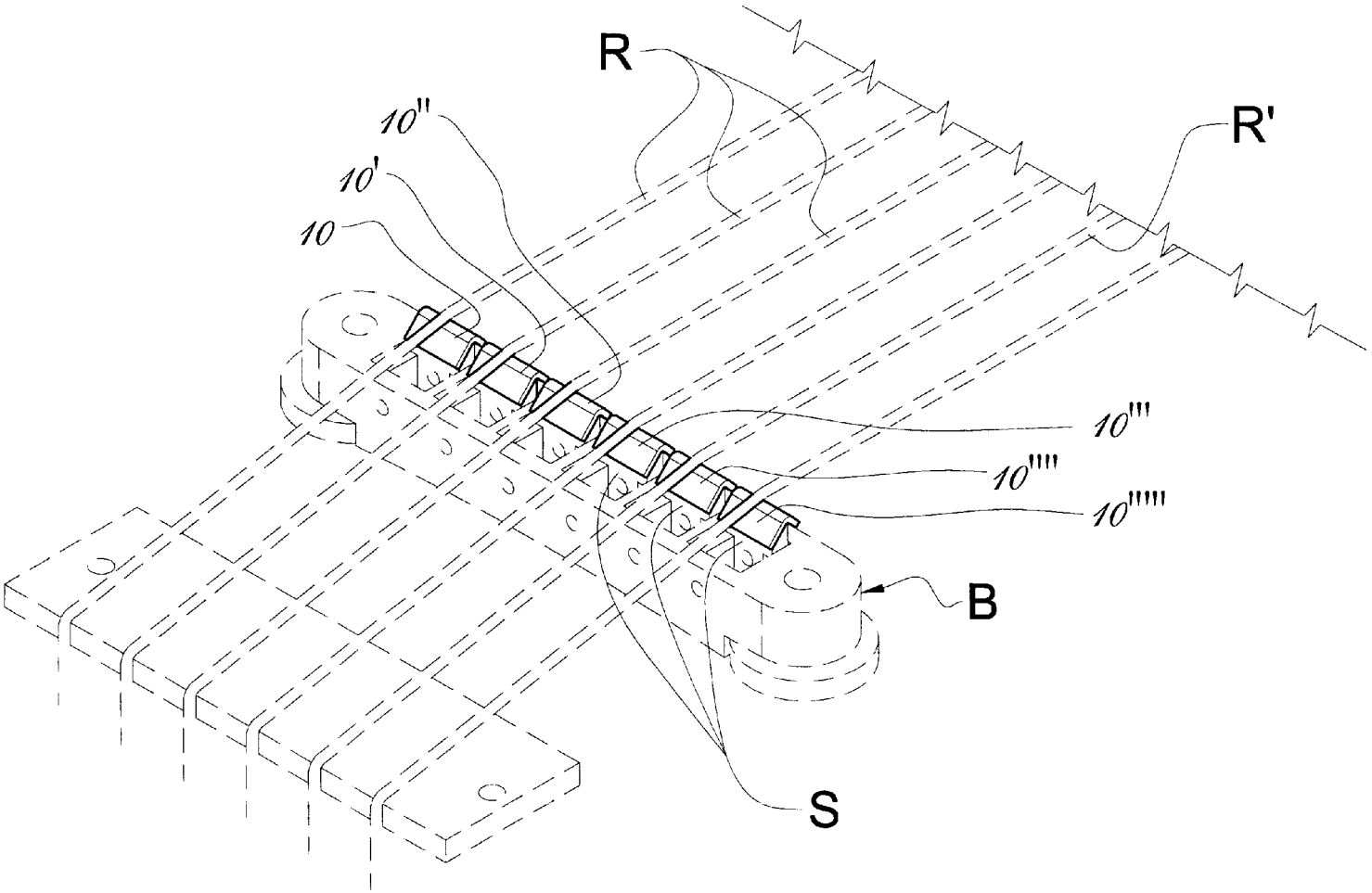
FIGS. 6 and 7 are perspective views of the elements of FIG. 5, with FIG. 7 showing how one elbowed sheet piece moves as one with a corresponding string having been laterally displaced relative to the bridge assembly, while the corresponding bridge saddle remains stationary.
Figure 7:
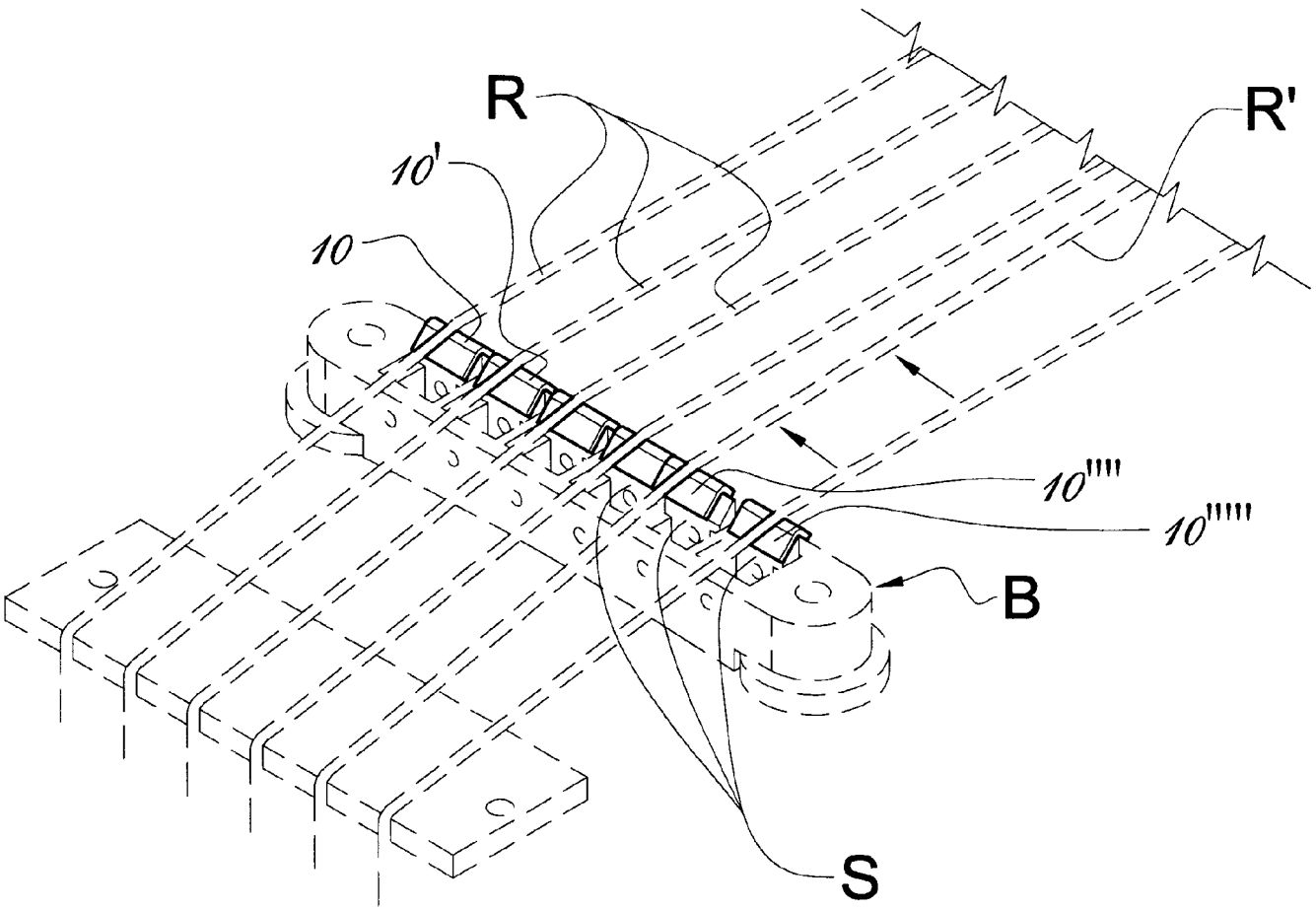

The present invention is thus directed at a stringed instrument suspension system, or so-called guitar string "shock absorber". As suggested in FIGS. 6 and 7, free floating V-shape metallic corner (or elbowed) pieces 10, 10', 10", . . . are sandwiched between the bridge corresponding saddle S and the string registering section R, under tension from the loaded string.

In use, as the string is repeatedly struck, the free floating corner piece moves together with the string, "as one", thus shielding the string from shearing forces borne from the bridge saddle. This can be seen sequentially in FIGS. 6 and 7 respectively, for elbowed piece 10"" and the corresponding string R', which both move laterally as one over the stationary corresponding saddle S. The elbowed piece 10"" slides lengthwisely on the bridge saddle, during the string motion, thus not affecting the sound intonation brought by the bridge assembly and string combination.

The sheet piece 10 will have a thickness sufficient for its above-noted stated purposes, for example 1 mm. One leg of the rigid elbowed sheet piece is preferably shorter than the other one, to conformingly fit with saddles if the saddle S forms a right triangle in cross-section as illustrated in FIG. 5. The material of the elbowed sheet piece may be soft metal, preferably a lightweight one, for example aluminum or titanium; or hardwood, bone, silver, gold, diamond, graphite, hard plastic, chrome, nickel, brass, bronze, or any other suitably rigid, hard or soft sheet material.

This elbowed sheet piece 10 provides protection for the string, and in particular against the following:

Breaking, including string bending, double-picking, during the vibrato technique, or during strumming;

Losing its tone from wear and tear;

this elbowed sheet piece 10 also provides protection by shielding the saddle from wearing out due to frictional forces from the string; and Works well even with worn out saddles.

Indeed, whenever the string R moves, the "shock absorber" elbowed piece 10 also moves. When the string R is released, the sheet elbowed piece 10 and associated string R return to their original starting conditions and positions with no frictional shearing forces whatsoever being sustained by the string from the saddle, since the string R is shielded from the sharp upturned edge tip of the saddle S by the apex 16 of the rigid elbowed sheet piece 10. This elbowed sheet piece 10 substantially eliminates the frictional shearing effect that used to apply between intonation saddle and string.

Figure 4:
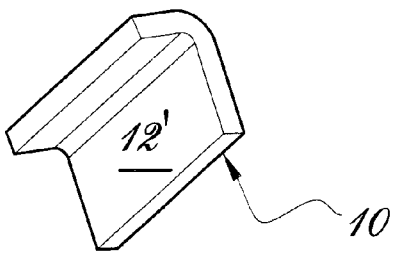

For easier string sliding over the elbowed sheet piece 10, a lead pencil is preferably used to mark the underface of the elbowed sheet piece, and lay a layer of lead material 12' (FIG. 4) thereon. Once the sheet piece 10 is in place in its operative position sandwiched between saddle S and string R, each string R may then be tuned with guitar head tuning pegs (not shown). Once each and every string has been tuned, the guitar can be played.

Although reference to a guitar instrument has been made throughout this specification with respect to the use of the elbowed rigid sheet piece, it is envisioned to be within the scope of the present invention that other stringed instruments, in particular stringed musical instruments such as for example a lute, a violin or even a bass, could also benefit from the teachings of this invention.

I claim:

1. An elbowed rigid sheet piece for use over a stationary bridge saddle in free floating fashion between the latter and a movable guitar string, said sheet piece defining a first leg and a second leg integrally joined to one another by an apex area, said sheet piece defining an arcuate underface, for complementary engagement with the bridge saddle, and an outer face, the apex area of said outer face for transverse frictional engagement by the guitar string, wherein said sheet piece is adapted to move as one with the string over the stationary bridge saddle both as this string is struck by a guitar player and as this string is released by the guitar player.

2. An elbowed sheet piece as in claim 1, wherein the angular value at said underface of said elbowed sheet piece ranges between about 30 and 135 degrees.

3. An elbowed sheet piece as in claim 1, wherein the length of said sheet piece ranges between 4 and 9 mm.

4. An elbowed sheet piece as in claim 1, wherein said sheet piece first leg is shorter than said sheet piece second leg.

5. An elbowed sheet piece as in claim 1, further including a notch made transversely of a central portion of said apex portion of said sheet piece outer face, said notch for containment engagement by a string.

6. An elbowed sheet piece as in claim 1, wherein the material forming said sheet piece is selected from aluminum, titanium, hardwood, bone, silver, gold, diamond, graphite, hard plastic, chrome, nickel, brass and bronze.

7. A sheet piece as in claim 1, further including a lead layer applied on said sheet piece underface.

8. In combination, an inversely V-shape saddle for use as an integral stationary part of a guitar bridge assembly, and an elbowed rigid sheet piece positioned over said bridge saddle in.free floating fashion, said sheet piece for use in being taken in sandwich between said saddle and a guitar string, said sheet piece defining a first leg and a second leg integrally joined to one another by an apex area, said sheet piece defining an arcuate underface, complementarily engaging with the bridge saddle, and an outer face, the apex area of said outer face for transverse frictional engagement by the guitar string, wherein said sheet piece is adapted to move as one with the string over said stationary bridge saddle both as this string is struck by a guitar player and as this string is released by this guitar player.

9. A saddle and sheet piece combination as in claim 8, wherein the angular value at said underface of said elbowed sheet piece ranges between about 30 and 135 degrees, and the angular value of said saddle is equal to or greater by up to about 45 degrees relative to the angular value of said elbowed sheet piece.

10. A saddle and sheet piece combination as in claim 8, wherein the length of said sheet piece ranges between 4 and 9 mm.

11. A saddle and sheet piece combination as in claim 8, wherein said saddle forms a right triangle in cross-section and wherein said sheet piece first leg is accordingly shorter than said sheet piece second leg.

12. A saddle and sheet piece combination as in claim 8, further including a notch made transversely of a central portion of said apex portion of said sheet piece outer face, said notch for containment engagement by a string.

13. A saddle and sheet piece combination as in claim 8, wherein the material forming said sheet piece is selected from aluminium, titanium, hardwood, bone, silver, gold, diamond, graphite, hard plastic, chrome, nickel, brass and bronze.

14. A saddle and sheet piece combination as in claim 8, further including a lead layer applied on said sheet piece underface.

15. An electric guitar of the type including a main body, a bridge assembly projecting from said solid body integrally thereof, at least one elongated string fixedly secured at one end to said solid body and transversely straddling over an inversely V-shape saddle member forming part of said bridge assembly, and an elbowed rigid sheet piece positioned over said saddle member, said sheet piece taken in sandwich between said saddle member and said string in free floating fashion, said sheet piece defining a first leg and a second leg integrally joined to one another by an apex area, said sheet piece defining an arcuate angle underface, complementarily engaging with said saddle member, and an outer face, the apex area of said outer face for transverse frictional engagement by the guitar string, wherein said sheet piece moves as one with the string over the stationary said saddle member both as this string is struck by a guitar player and as this string is thereafter released by the guitar player.

16. An electric guitar as in claim 15, further including a lead layer applied on said sheet piece arcuate underface.

17. An electric guitar as in claim 15, wherein the length of said sheet piece ranges between 3 and 9 mm.

18. An electric guitar as in claim 15, wherein said saddle forms a right triangle in cross-section and wherein said sheet piece first leg is accordingly shorter than said sheet piece second leg.

19. An electric guitar as in claim 15, further including a notch made transversely of a central portion of said apex portion of said sheet piece outer face, said notch engaged by and providing containment of said string.

20. An elbowed sheet piece as in claim 15, wherein the material forming said sheet piece is selected from aluminum, titanium, hardwood, bone, silver, gold, diamond, graphite, hard plastic, chrome, nickel, brass, and bronze.

* * * * *